US005803135A

United States Patent [19]

Wahhoud et al.

[11] Patent Number: 5,803,135

[45] Date of Patent: Sep. 8, 1998

[54] METHOD AND SELVAGE FORMING DEVICE FOR AN AIR WEAVING LOOM

[75] Inventors: Adnan Wahhoud, Lindau-Bodolz; Hans-Dieter Scorl; Peter Schiller, both of Lindau; Peter Czura, Wangen; Werner Birner, Lindau, all of Germany; Josef Hehle, Hoerbranz, Austria

[73] Assignee: Lindauer Dornier Gesellschaft mbH, Lindau, Germany

[21] Appl. No.: 769,788

[22] Filed: Dec. 18, 1996

[30] Foreign Application Priority Data

Dec. 27, 1995 [DE] Germany ..... 195 48 846.6

[51] Int. Cl.[6] ..... D03D 47/48

[52] U.S. Cl. ..... 139/434

[58] Field of Search ..... 139/430, 434

[56] References Cited

U.S. PATENT DOCUMENTS 4,552,187 11/1985 Bertsch et al. ..... 139/434

4,984,608 1/1991 Bertsch et al. ..... 139/434

FOREIGN PATENT DOCUMENTS 0 149969 7/1985 European Pat. Off. .

0 483067 4/1992 European Pat. Off. .

0 534 429 3/1993 European Pat. Off. ..... 139/434

*Primary Examiner*—Andy Falik

*Attorney, Agent, or Firm*—W. G. Fasse; W. F. Fasse

[57] ABSTRACT

A wide selvage is formed along a fabric edge in a weaving loom by at least two selvage forming heads arranged in a row with an outer selvage forming head (9) and an inner selvage forming head (8) positioned between the outer selvage forming head (9) and an edge of a fabric. The outer selvage forming head (9) seizes a weft end and transmits it to the inner selvage forming head (8) which inserts it into the shed for beat-up. Both forming heads work pneumatically and in tandem with each other. A set of two selvage forming heads (8, 9) is arranged at each fabric edge.

10 Claims, 2 Drawing Sheets

METHOD AND SELVAGE FORMING DEVICE FOR AN AIR WEAVING LOOM

FIELD OF THE INVENTION

The invention relates to forming wide selvages in a weaving loom using a pneumatic so-called "reacher-in" or insertion device cooperating with a cutter for binding weft thread ends into the selvage.

BACKGROUND INFORMATION

So-called "reacher-in" or insertion devices are well known in the art. These devices insert a leading and/or trailing end of the weft thread into the loom shed so that the next beat-up will bind the respective weft thread end into the selvage. In a pneumatic or air nozzle weaving loom the insertion device is normally a blowing nozzle which seizes the weft thread end and blows it back into the open next following loom shed. Such insertion results in a so-called reacher-in or insertion selvage, whereby the fabric is strengthened along the selvage edge to about twice the normal fabric strength due to doubling of the weft thread within the area of the selvage. Conventional insertion or tucker selvages have a width of at least one, normally a few to several centimeters.

However, such widths are achieved with the help of a tucker needle as shown for example in U.S. Pat. Nos. 4,552,187 (Bertsch et al.) and 4,984,608 (Bertsch et al.)

Such wide insertion selvages are desirable depending on the intended use of the finished fabric. For example, in connection with fabrics for tent making and for tarpaulins the strengthened selvage is very well suited for the securing of eyelets or similar elements for tying down the tent or tarpaulin. In connection with other uses, there is even the need for a rather wide selvage where the intended use particularly strains the fabric edges, for example in filter fabrics and the like. Such wide selvages cannot be formed by conventional equipment.

OBJECTS OF THE INVENTION

In view of the above it is the aim of the invention to achieve the following objects singly or in combination:

- to provide a method and device for the insertion of weft thread ends into the loom shed for the selvage formation in such a way that substantially wider selvages can be formed compared to the width of conventional selvages as measured in the weft direction;
- to provide a pneumatic insertion device that functions with a relay or tandem feature to provide the required selvage width; and
- to strengthen a fabric edge without the need for hemming, bordering, overlooking, or the like.

SUMMARY OF THE INVENTION

The invention achieves the above objects by using at least two pneamatic insertion heads in tandem in the weft insertion direction. The insertion heads due to the tandem arrangement and cooperation of at least two pneumatic insertion heads are operated so that a first insertion head positioned with a spacing from the fabric edge, the weft end and hands it over to a second insertion head that blows the weft end into an open shed, preferably the next open shed.

It is an important feature of the invention that each pneumatic weft reacher-in or insertion device for the weft thread ends comprises at least two pnuematic insertion heads arranged in tandem rather than merely one as is conventional. The two or more pnuematic insertion heads cooperate in relay fashion so that the weft thread end such as the leading end and/or the trailing end, is inserted into the selvage to its full length that depends on the total width of all insertion heads arranged in a row.

At least on the side of the weft entrance into the weft insertion channel there is a cutter in a position upstream of the outer insertion head for properly cutting the trailing end of the weft thread being inserted.

By arranging several pnuematic weft insertion heads in a row, the invention assures that following the cutting of the weft thread a relatively long weft thread end is available for tucking into the selvage formation. This relatively long weft end corresponds in its length to the entire width of all insertion heads arranged in a row.

The present method and apparatus are capable of handling a substantially longer weft end and to insert that longer weft end into the loom shed than was possible heretofore, whereby a very wide so-called insertion selvage can be formed due to the tandem arrangement and cooperation of at least two pneumatic insertion heads. This feature greatly increases the selvage strength of the fabric which is necessary in many applications or uses of the fabric as has been pointed out above, whereby the user of the fabric does not need to perform any fabric edge strengthening operation such as an overlooking stitching operation.

DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
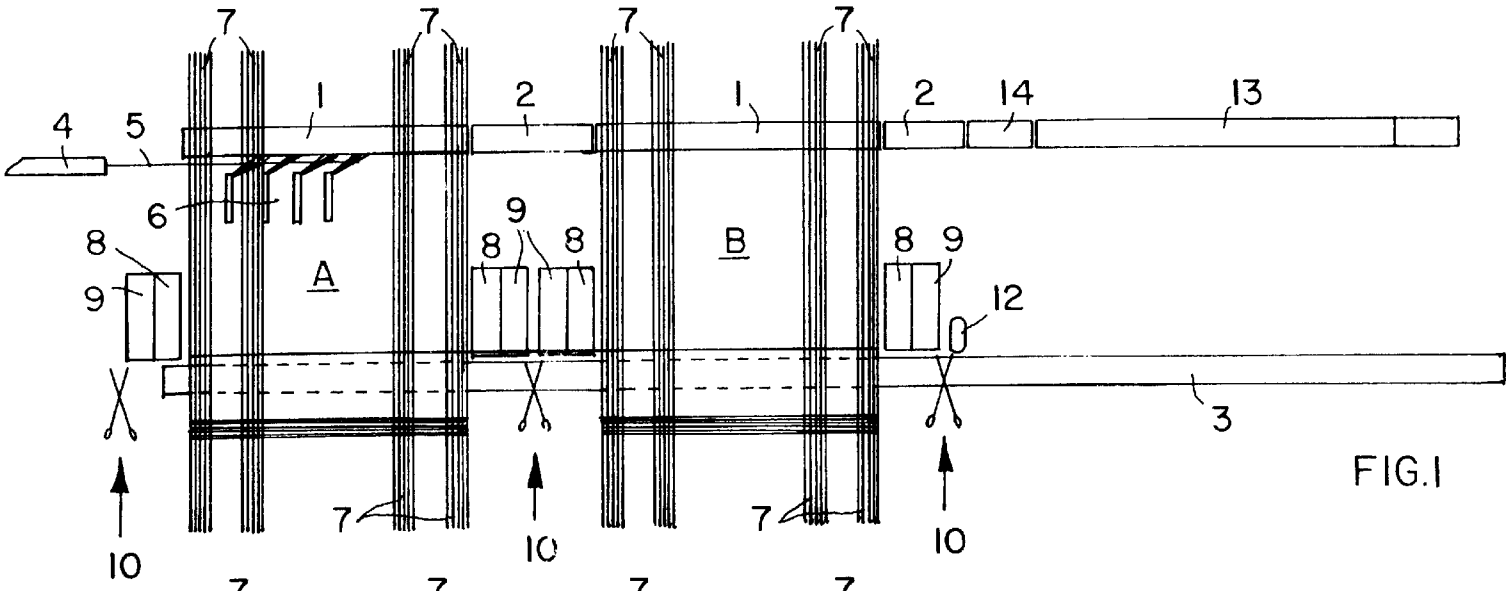
FIG. 1 is a schematic top plan view onto the shed formed in a pneumatic loom, whereby the reed is shown in its rear position.
Figure 2:
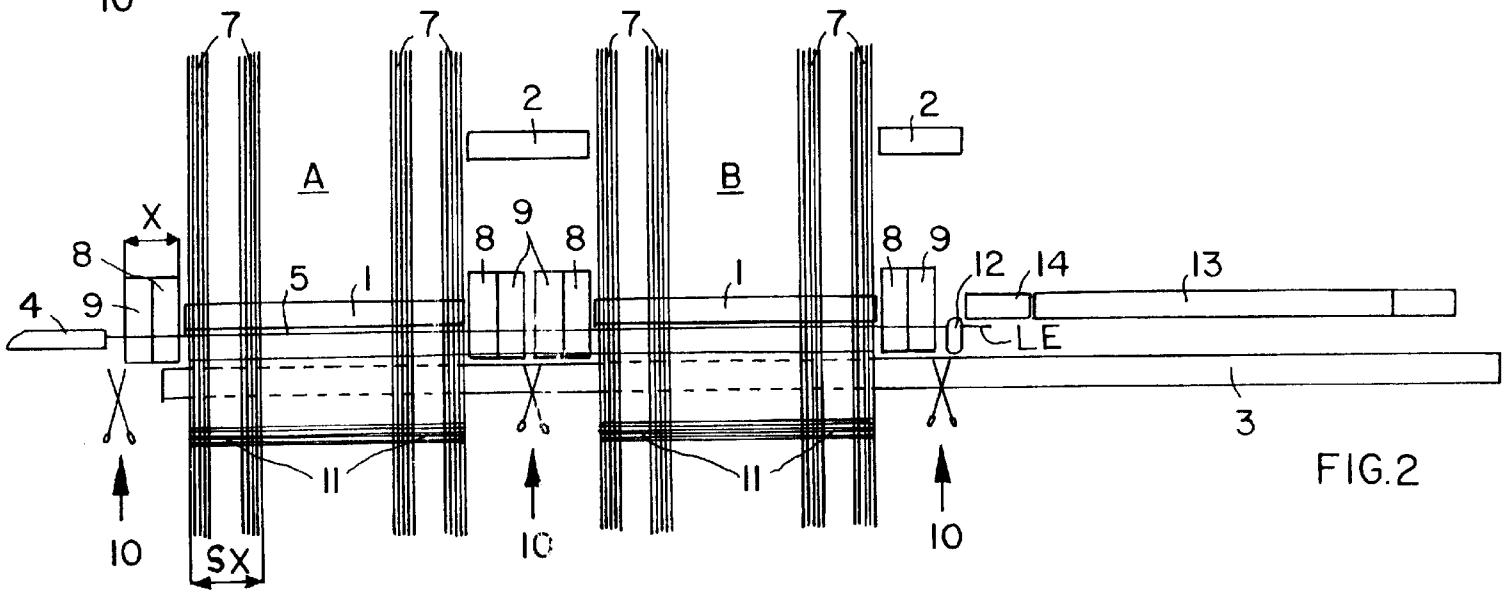
FIG. 2 is a view as in FIG. 1, however, showing the reed in its beat-up position.

Referring to FIGS. 1 and 2, the invention is illustrated for example in connection with a pneumatic weaving loom having several shed sections A, B, . . . . Thus, the reed 1 also has several sections and these sections are separated by filler pieces 2. Warp threads 7 are not provided in the area of the filler pieces 2. The filler pieces 2 are stationary and remain in position when the reed 1 moves into the beat-up-position shown in FIG. 2. As shown at the top of FIG. 1, the filler pieces 2 are axially aligned with the reed sections 1 when the latter are in the rear position.

The fabric runs over a spreader table 3 extending over the entire width of the loom, whereby the warp threads 7 form the shed between the reed 1 and the spreader table 3. A weft thread 5 is inserted into the shed by a main nozzle 4 or rather into the weft insertion channel in the loom, whereby auxiliary nozzles 6 pass the weft thread 5 from the entrance side to the exit side of the loom. A stretcher nozzle 13 seizes the leading end of the weft thread at the exit end as is conventional. A weft stop motion device 14 monitors whether the weft thread 5 has properly arrived at the exit end of the insertion channel. If the check signifies the proper arrival of a weft thread 5 and if the leading end has been seized by the stretcher nozzle 13, the reed 1 performs together with the stretcher nozzle 13 and the weft stop motion device 14 the beat-up of the inserted weft thread by moving into the beat-up position shown in FIG. 2.

According to the invention at least two reacher-in or pneumatic insertion heads 8 and 9 are positioned in a row or in tandem with each other at each fabric edge. These heads 8, 9 are all of the same construction and hence have the same reference numbers. The heads 8 and 9 are arranged in series or in a tandem with each other as viewed in the direction of the weft thread insertion from left-to-right in FIGS. 1 and 2. However, the outer head 9 is spaced from the fabric edge sufficiently to leave space for the positioning of the inner head 8. In other words, the outer head 9 is always positioned further away from the fabric edge than the inner head 8. A cutter 10 is positioned to cooperate with the respective group of weft end insertion 8, 9. With regard to the entrance side of each loom section A, B the cutter is positioned upstream of the respective group of insertion heads as viewed in the weft insertion direction. However, with respect to the exit edge of the respective fabric section, the cutters 10 are positioned downstream of the respective group of insertion heads 8, 9. The cutters 10 become effective after the reed has assumed its beat-up position shown in FIG. 2.

A suction device 12 is positioned downstream of the respective cutter 10 for removing any remainder length of the leading end LE of the weft threads. The remaining leading end LE and cut or trailing end TE of the weft thread extending through the insertion heads 8 and 9 on both sides of the loom are then seized by the respective outer head 9 and handed over to the inner head 8 which blows the respective weft thread ends LE and TE into an open shed, preferably the next shed being formed to bind the weft ends into the selvage 11 with the next beat-up. The group of insertion heads 8 and 9 or additional such heads will have perhaps a width X in the weft insertion direction and that width corresponds to the desired selvage width SX.

Figure 3:
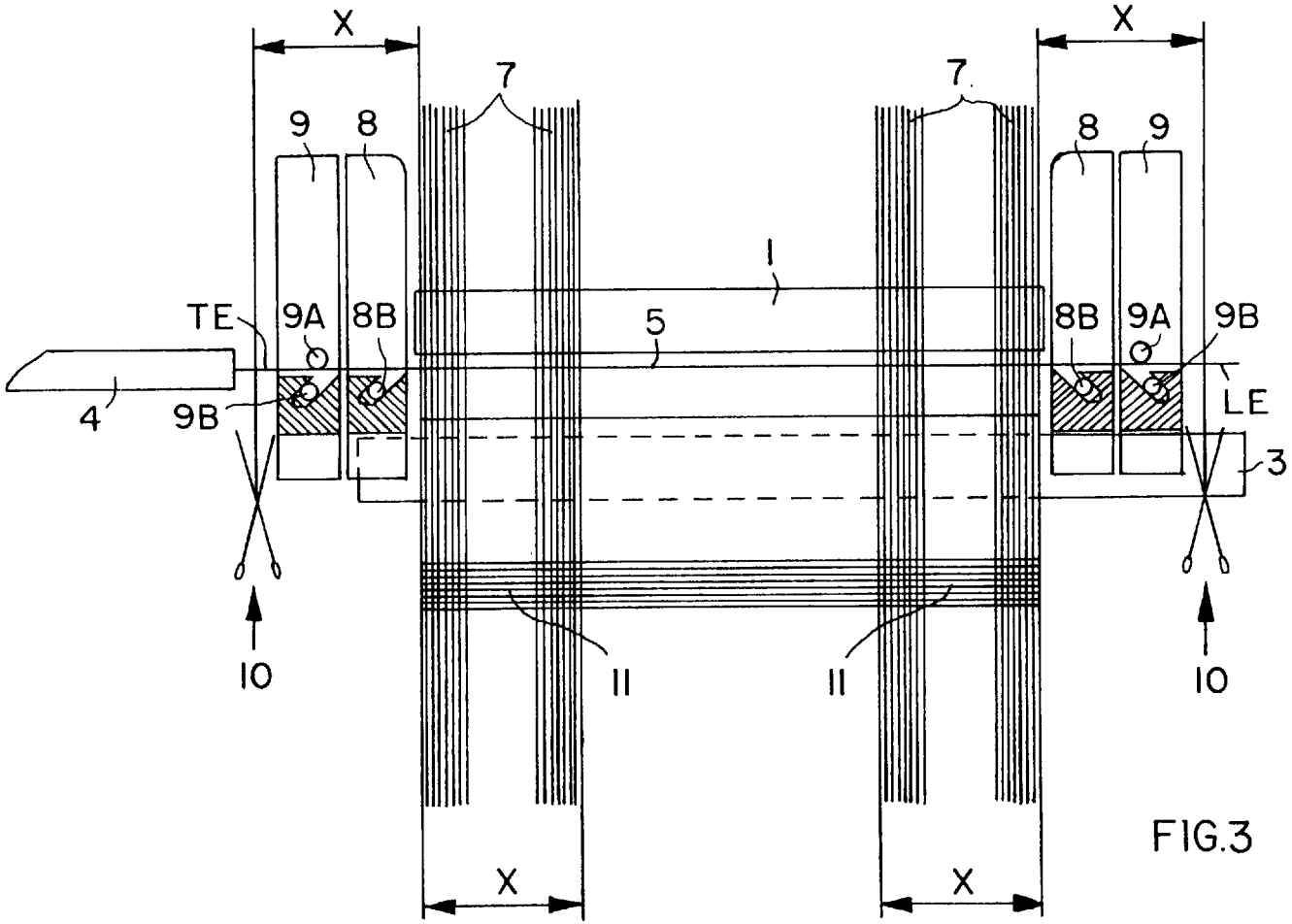
FIG. 3 is a view of the left-hand lower portion of FIG. 2 on an enlarged scale to illustrate details of two pneumatic weft end insertion heads arranged in tandem with each other.

Referring to FIG. 3, the operation of the present weft end inserters 8, 9 will now be described. As soon as the weft 5 has been cut by cutters 10 at its trailing end TE, and between two groups of inserter heads, the outer head 9 seizes the weft thread end with its suction nozzle 9A and then transports the seized thread with its blowing nozzle 9B into the effective range of the blowing nozzle 8B of the inner insertion head 8. Thus, in FIG. 3 the trailing end TE of the weft 5 is moved in the weft insertion direction. However, the leading ends LE are seized by the respective suction nozzle 9A and presented to the blowing nozzles 9B and 8B in a direction opposite to the weft insertion direction. The just described pneumatic insertion of the weft ends results in a selvage 11 having the selvage width SX that depends on the total width of the heads 8 and 9. By using two heads, for example, the selvage width can be doubled. More than two such heads 8 and 9 can be used in accordance with the required selvage width. Thus, the present method and device permit the formation of any desired selvage width.

Although the invention has been described with reference to specific example embodiments, it will be appreciated that it is intended to cover all modifications and equivalents within the scope of the appended claims.

What is claimed is:

1. A method for forming a wide selvage along at least one edge of a fabric in a weaving loom, said method comprising the following steps:

(a) transporting a weft thread having leading weft end through an open warp shed in a weft insertion direction and cutting an inserted weft thread to provide a trailing weft end, (b) pneumatically seizing at least one of said leading and trailing weft ends with a first pneumatic selvage former, (c) pneumatically transferring a weft end seized by said first pneumatic selvage former to a second pneumatic selvage former, so that said first and second pneumatic selvage formers cooperate in tandem with each other in said weft insertion direction, (d) pneumatically inserting said weft end transferred to said second pneumatic selvage former into a following open warp shed to provide an inserted weft end, and (e) tying said inserted weft end into said wide selvage with a beat-up.

2. The method of claim 1, further comprising performing said steps (a) to (d) for each of said weft ends to form said wide selvage along two fabric edges.

3. A selvage forming device for a weaving loom, said selvage forming device comprising at least a first pneumatic selvage forming head (9) positioned with a spacing from a fabric edge in a weaving loom for pneumatically seizing and transferring a weft end (LE, TE), and at least one second pneumatic selvage forming head (8) positioned in said spacing for pneumatically receiving said weft end and pneumatically tucking a received weft end into a warp shed for beat-up, wherein said first and second pneumatic selvage forming heads (9, 8) are arranged in series with each other in a weft insertion direction for a tandem cooperation with each other.

4. The selvage forming device of claim 3, comprising said first pnuematic selvage forming head (9) and said second pnuematic selvage forming head (8) on each side of said weaving loom.

5. The selvage forming device of claim 3, wherein said first and second pnuematic selvage forming heads are positioned in a row in alignment and next to each other as viewed in a weft insertion direction.

6. The selvage forming device of claim 5, wherein said first pnuematic selvage forming head (9) is an outer pnuematic weft insertion head and said second pnuematic selvage forming head (8) is an inner weft pnuematic insertion head as viewed relative to said fabric edge.

7. The selvage forming device of claim 3, further comprising a cutter (10) arranged ahead or following said first pnuematic selvage forming head (9) as viewed in the weft insertion direction.

8. The selvage forming device of claim 3, wherein said first and second pnuematic selvage forming heads (9, 8) together have a width (X) in the weft insertion direction, said width (X) corresponding approximately to a required selvage width (SX).

9. The method of claim 1, wherein said following open warp shed is a next open warp shed formed following a beat-up of said weft thread.

10. The selvage forming device of claim 3, wherein said first pneumatic selvage forming head (9) comprises a suction nozzle (9A) for seizing said weft end and a blowing nozzle (9B) for transferring said weft end to said second pneumatic selvage forming head, and wherein said second pneumatic selvage forming head comprises at least a blowing nozzle (8B) for inserting said weft end into a warp shed.

* * * * *

UNITED STATES PATENT AND TRADEMARK OFFICE

CERTIFICATE OF CORRECTION

PATENT NO. : 5,803,135

DATED : Sep. 8, 1998

INVENTOR(S) : Wahhoud et al.

It is certified that error appears in the above-identified patent and that said Letters Patent is hereby corrected as shown below:

On the title page, under [54],
replace "METHOD AND SELVAGE FORMING DEVICE FOR AN AIR WEAVING LOOM" by --PNEUMATIC WIDE SELVAGE FORMING DEVICE--;

| | | |
|---|---|---|
| Col. 1, lines 1 and 2, | | replace "METHOD AND SELVAGE FORMING DEVICE FOR AN AIR WEAVING LOOM" by --PNEUMATIC WIDE SELVAGE FORMING DEVICE--; |
| | line 53, | after "bordering," replace "overlooking" by --overlocking--; |
| | line 58, | after "two" replace "pneamatic" by --pneumatic--; |
| | line 59, | after "heads" delete "due to the tandem"; |
| | line 60, | delete the entire line; |
| | line 61, | before "are" delete "insertion heads"; |
| | line 62, | after "edge," insert --seizes--; |
| | line 67, | after "two" replace "pnuematic" by --pneumatic--; |
| Col. 2, line 2, | | after "more" replace "pnuematic" by --pneumatic--; |
| | line 11, | after "several" replace "pnuematic" by --pneumatic--; |
| | line 28, | after "an" replace "overlooking" by --overlocking--; |
| | line 30, | before "DESCRIPTION" insert --BRIEF--; |
| | line 42, | after "other" insert --according to the invention--; |
| Col. 2, line 60, | | after "4" insert --,--; |

UNITED STATES PATENT AND TRADEMARK OFFICE
CERTIFICATE OF CORRECTION

PATENT NO. : 5,803,135

DATED : Sep. 8, 1998

INVENTOR(S) : Wahhoud et al.

It is certified that error appears in the above-identified patent and that said Letters Patent is hereby corrected as shown below.

| | | |
|---|---|---|
| Col. 3, | line 11, | after "in" **(first occurrence)** delete "a"; |
| | line 18, | after "insertion" insert --heads--; |
| | line 42, | after "TE" delete ","; |
| Col. 4, | line 1, | after "having" insert --a--; |
| | line 34, | after "first" replace "pnuematic" by --pneumatic--; |
| | line 35, | before "selvage" replace "pnuematic" by --pneumatic--; |
| | line 38, | after "second" replace "pnuematic" by --pneumatic--; |
| | line 42, | after "first" replace "pnuematic" by --pneumatic--; after "outer" replace "pnue-" by --pneu---; |
| | line 43, | after "second" replace "pnuematic" by --pneumatic--; |
| | line 44, | after "weft" replace "pnuematic" by --pneumatic--; |
| | line 48, | before "selvage" replace "pnuematic" by --pneumatic--; |
| | line 51, | after "second" replace "pnuematic" by --pneumatic--; |

Signed and Sealed this

Eighth Day of December, 1998

*Attest:*

*Attesting Officer*

BRUCE LEHMAN

*Commissioner of Patents and Trademarks*